US008590233B2

(12) United States Patent
Sprague

(10) Patent No.: US 8,590,233 B2
(45) Date of Patent: Nov. 26, 2013

(54) STACKING WALL PANEL SYSTEM AND METHODS OF INSTALLATION AND USE

(76) Inventor: Gary Sprague, Los Angeles, CA (US)

( * ) Notice: Subject to any disclaimer, the term of this patent is extended or adjusted under 35 U.S.C. 154(b) by 385 days.

(21) Appl. No.: 11/595,592

(22) Filed: Nov. 9, 2006

(65) Prior Publication Data

US 2008/0109989 A1 May 15, 2008

(51) Int. Cl.
*E04H 1/00* (2006.01)

(52) U.S. Cl.
USPC ..... 52/243.1; 52/238.1; 16/91

(58) Field of Classification Search
USPC ..... 52/238.1, 243.1, 235; 16/91
See application file for complete search history.

(56) References Cited

U.S. PATENT DOCUMENTS

| | | | | |
|---|---|---|---|---|
| 3,253,552 | A | 5/1966 | Stein | |
| 3,708,916 | A | 1/1973 | Karp, Jr. et al. | |
| 3,843,995 | A | 10/1974 | Merrill | |
| 3,879,799 | A | 4/1975 | Williams | |
| 4,141,106 | A * | 2/1979 | Dixon | 16/89 |
| 4,229,857 | A | 10/1980 | Toder | |
| 4,302,865 | A | 12/1981 | Dixon et al. | |
| 4,401,033 | A * | 8/1983 | Gerken | 104/94 |
| 4,555,828 | A * | 12/1985 | Matimura | 16/95 R |
| 4,573,286 | A | 3/1986 | Favrel et al. | |
| 4,752,987 | A | 6/1988 | Dreyer et al. | |
| 4,837,891 | A | 6/1989 | Toma et al. | |
| 4,845,806 | A | 7/1989 | Hamacher | |
| 4,991,257 | A | 2/1991 | Eutebach | |
| 5,016,318 | A | 5/1991 | Harris | |
| 5,031,274 | A | 7/1991 | Eutebach | |
| 5,063,636 | A | 11/1991 | Dickson | |
| 5,152,332 | A | 10/1992 | Siener | |
| 5,181,296 | A | 1/1993 | Williams | |
| 5,295,281 | A | 3/1994 | Kordes | |
| 5,357,651 | A | 10/1994 | Jones et al. | |
| 5,394,648 | A | 3/1995 | Kordes | |
| 5,406,676 | A | 4/1995 | Williams | |
| 5,448,855 | A * | 9/1995 | Sjoholm | 49/125 |
| 5,499,671 | A | 3/1996 | Owens | |
| 5,544,462 | A | 8/1996 | Kordes | |
| 6,220,173 | B1 * | 4/2001 | Sauerwein | 104/130.01 |
| 6,233,878 | B1 * | 5/2001 | Krahenbuhl et al. | 52/64 |
| 6,374,456 | B1 | 4/2002 | Fort et al. | |
| 6,481,359 | B1 | 11/2002 | Owens | |
| 6,581,242 | B2 | 6/2003 | Owens | |
| 6,598,355 | B2 | 7/2003 | Owens | |
| 6,698,491 | B2 | 3/2004 | Goldsmith et al. | |
| 7,174,944 | B1 * | 2/2007 | Clark et al. | 160/197 |
| 2008/0109989 | A1 * | 5/2008 | Sprague | 16/91 |

* cited by examiner

*Primary Examiner* — Branon Painter
(74) *Attorney, Agent, or Firm* — Mitchell P. Brook; McKenna, Long & Aldridge LLP

(57) ABSTRACT

A wall panel system and method of installation and use are provided, in which wall panels are suspended from trolleys along a track system. The trolleys include guide devices that interact with diverters coupled to the tracks to allow the trolley to be directed as desired at intersections of the tracks, and to follow a predetermined path along the track system. The wall panel system is configurable to allow the wall panels to be aligned serially, such as for dividing the space within a room, or may be stacked, such as suitable for compact storage.

18 Claims, 16 Drawing Sheets

STACKING WALL PANEL SYSTEM AND METHODS OF INSTALLATION AND USE

FIELD OF THE INVENTION

The present invention relates to movable wall panel systems, and in particular to suspended wall panels capable of serial or parallel configuration.

BACKGROUND OF THE INVENTION

Movable wall panels are used to divide an area into two or more regions. For example, movable wall panels are employed in schools, hotels, and convention centers to divide a large room into two or more smaller rooms. Another common use of movable wall panels is the formation of individual shop fronts within a mall. Clear glass panels are typically stored during business hours to produce a wide-open storefront, and are disposed in front of the storefront during off-business hours to permit the viewing of merchandise, with a pivot door providing selective access.

Movable wall panel systems typically include several components, such as wall panels, trolleys coupled to the wall panels, and tracks within which the trolleys can slide and displace the wall panels. The wall panels are often large planar structures that may be freestanding or attached to one another end-to-end. Many modern applications of wall panel systems utilize freestanding wall panels in order to allow greater versatility over systems using wall panels that are attached end-to-end.

Wall panels are often suspended from the trolleys by pendant bolts. Trolleys, or carriages, are generally wheeled devices that move along tracks affixed to an overhead structure and disposed in the desired direction of travel of the wall panels. Tracks may have intersections or junctions that allow for different configurations of wall panels, resulting in variations in the geometries of the divided space.

When using tracks with intersections, junctions, or other transition points, a problem may arise when a wall panel must be moved across a transition point. In many known designs, a common type of transition point involves the intersection of two paths. As a result, a user may have to guide the wall panel along the proper path by looking up and trying to negotiate the trolley through the intersection, while continually advancing the large wall panel. Such a situation presents safety issues as the individual may be unable to watch both the trolley and his or her own footing.

Attempts have been made to overcome this problem with limited success. One example of such an attempt is demonstrated in U.S. Pat. No. 3,708,916 to Karp, Jr. et al., which describes a system having a trolley with two pair of horizontally rotating wheels oriented in different planes. One disadvantage with such a design is that the trolley may not roll smoothly through an intersection and may even become partially entrapped in the intersection when each wheel is aligned with an underlying opening in the track.

Other known designs have attempted to provide systems that are capable of smoothly negotiating an intersection. In this regard, U.S. Pat. No. 5,016,318 to Harris describes a track and trolley system with the ability to negotiate intersections without stopping. This system involves a trolley having four wheels mounted in laterally spaced tandem pairs for rotation about parallel horizontal axes, similar in configuration to a conventional automobile. One disadvantage of this system is that the trolley may be unable to travel laterally, or in the direction of the horizontal axes, traveling instead primarily fore and aft, or along the direction of wheel rotation.

One design that allows the trolley to make sharp turns is disclosed in U.S. Pat. No. 5,544,462 to Kordes, which is directed toward a door closer of a movable wall element, but which also discloses a trolley having four wheels each having a horizontal axis, none of which are collinear. Although this type of design may facilitate trolley movement in the two primary directions of wheel rotation, motion along other directions may be hindered.

Accordingly, there is a need for an improved wall panel system having a trolley that facilitates multidirectional travel.

There is also a need for an improved wall panel system capable of negotiating intersections with ease.

There is a further need for an improved wall panel system capable of being guided along predetermined pathways on a track having multiple pathway combinations.

SUMMARY OF THE INVENTION

The present invention alleviates to a great extent the disadvantages of the known wall panel systems by providing a wall panel system and related method of use, in which one or more wall panels are provided and mounted on trolleys moving along the interior of a track. The trolleys have wheels mounted along vertical axes that allow multidirectional travel and that facilitate sharp turns. Additionally, the wall panel system of the present invention includes diverters mounted along the track that interact with wheels affixed to the trolleys, thereby allowing the wall panel to be selectively guided along a predetermined path.

In one embodiment, the track is configured as an enclosure having a channel extending along the central area of its lower surface. Moreover, along either side of the channel the lower surface is beveled slightly downward toward the channel. The track may contain intersections and branches allowing the trolleys to follow a plurality of paths.

The trolley preferably has four horizontally-rotating wheels that are beveled along at least a portion of their surfaces, to create a larger contact area with the track's lower surface. A pendant bolt protrudes downward from the center of the trolley and is connected to a wall panel, which hangs suspended from the pendant bolt. A guide assembly, preferably comprising two guide devices, extends upward from the trolley's upper surface, and may interact with diverters that are positioned at or near the track's branches or intersections. In a preferred embodiment, the guide devices comprise wheels or rollers to reduce friction with the trolley. Through interaction between the guide devices and diverters, the wall panel may be easily directed along a preselected path.

These and other features and advantages of the present invention will be appreciated from a review of the following detailed description of the invention, along with the accompanying figures in which like reference numerals refer to like parts throughout.

BRIEF DESCRIPTION OF THE DRAWINGS

FIG. 3A-3J illustrate a track of a wall panel system in accordance with the present invention, wherein FIG. 3A shows the basic structure of the track, FIG. 3B shows a variant of the track of FIG. 3A, FIG. 3C shows the interaction of the track of FIG. 3A with the trolley of FIG. 2A, FIGS. 3D-3E show exemplary modular constructions of the track of FIG.

3A, FIGS. 3F-3G show exemplary reinforcement systems for the track of FIG. 3A, and FIGS. 3H-3J show exemplary hanger systems for the track of FIG. 3A;

DETAILED DESCRIPTION OF THE INVENTION

In the following paragraphs, the present invention will be described in detail by way of example with reference to the accompanying drawings. Throughout this description, the preferred embodiments and examples shown should be considered as exemplars, rather than as limitations on the present invention. As used herein, the "present invention" refers to any one of the embodiments of the invention described herein, and any equivalents. Furthermore, reference to various aspects of the invention throughout this document does not mean that all claimed embodiments or methods must include the referenced aspects.

Figure 1:
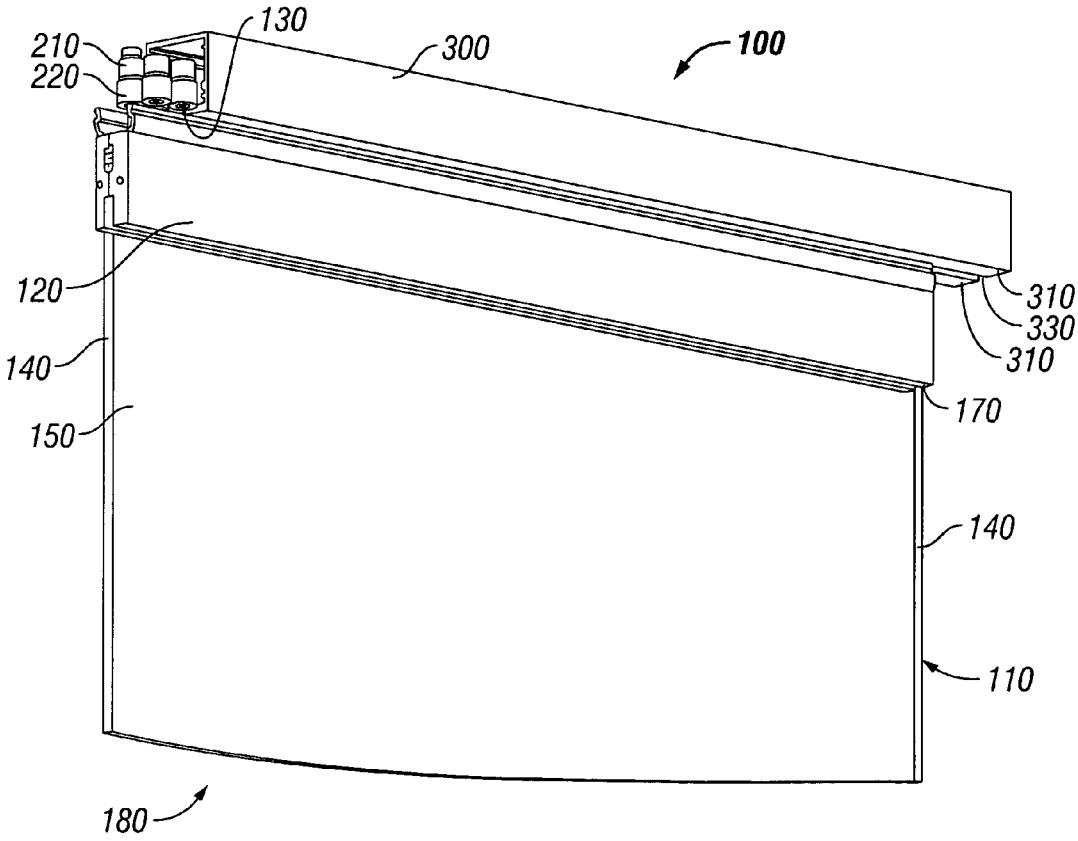
FIG. 1 is a perspective view of an embodiment of a wall partition system in accordance with the present invention.

An embodiment of a preferred wall panel system 100 is shown in FIG. 1. This embodiment includes the basic components of wall panel system 100, namely a wall panel 110, a trolley 200, and track 300. As shown in FIG. 1 and explained in further detail below, a trolley 200 comprises four horizontally-rotating wheels 220, which roll along the lower surfaces 310 of a track 300. Extending downward from the trolley 200 is a pendant bolt 210. Wall panel 110 is attached to pendant bolt 210 either directly or with a separate attachment device, such as a mount 120.

In the embodiment shown in FIG. 1, mount 120 is affixed to a wall panel top 170, and pendant bolt 210 is secured in a bolt receptacle 130 provided in wall panel top 170. In embodiments in which trolley 200 is attached directly to wall panel 110, wall panel 110 also comprises bolt receptacle 130.

Trolley 200 is free to rotate relative to wall panel 100. This relative movement may be accomplished by allowing pendant bolt 210 to rotate inside bolt receptacle 130, or alternatively by fixing pendant bolt 210 to bolt receptacle 130 and allowing other portions of trolley 200 to move relative to pendant bolt 210.

Wall panel 110 preferably is suspended from one or more trolleys 200 using pendant bolts 210. As a wall panel 110 is moved, pendant bolts 210 move through a channel 330, located between lower surfaces 310 of track 300.

A wall assembly 180 is comprised of a wall panel 110 and any components coupled hereto, such as trolleys 200 and mounts 120. In the presently described embodiment, wall assembly 180 has two trolleys 200 moving on a single path, causing edge 140 to be the leading or trailing surface. This configuration may be used to align wall assemblies 180 serially. In comparison, when a wall assembly 180 having two trolleys 200 is moving with each trolley 200 on a separate path, planar surface 150 may be the leading surface. This configuration may be used to stack the wall assemblies, as discussed in further detail below.

Figure 2A:
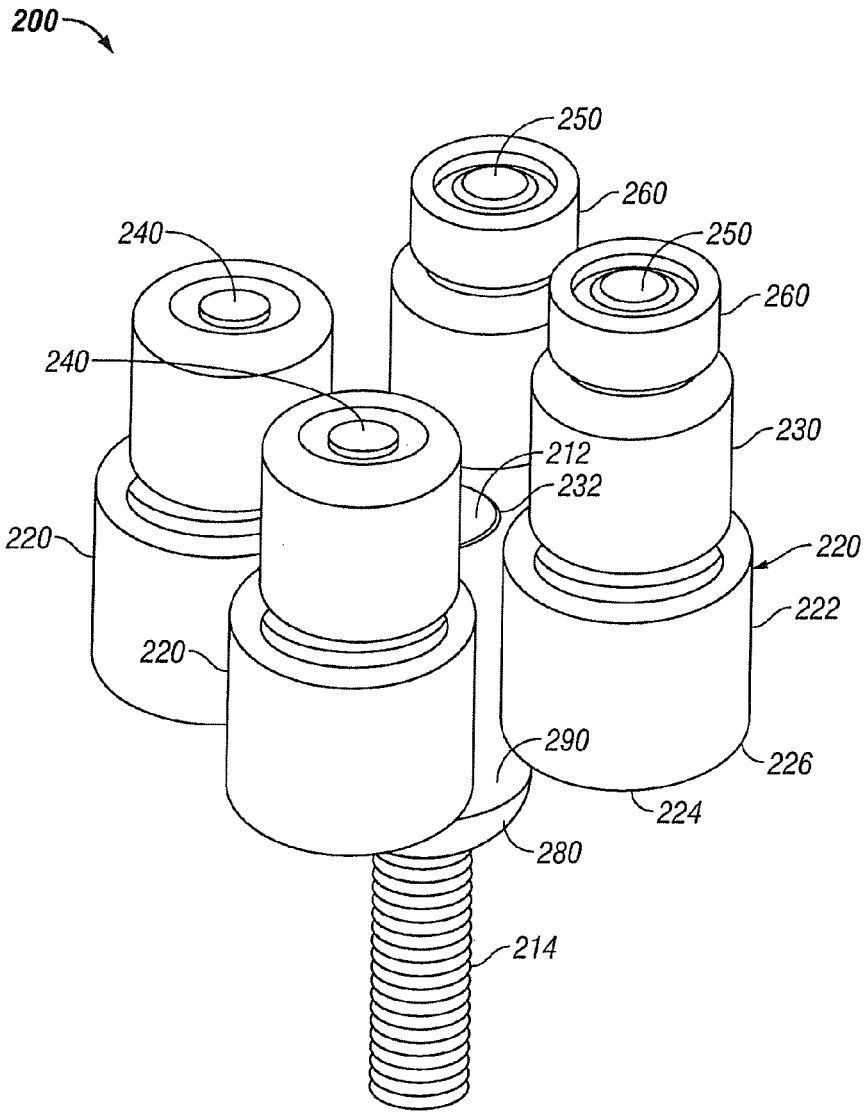
FIGS. 2A-2B are respectively a perspective view and a cross-sectional view of an embodiment of a trolley of a wall panel system in accordance with the present invention.
Figure 2B:
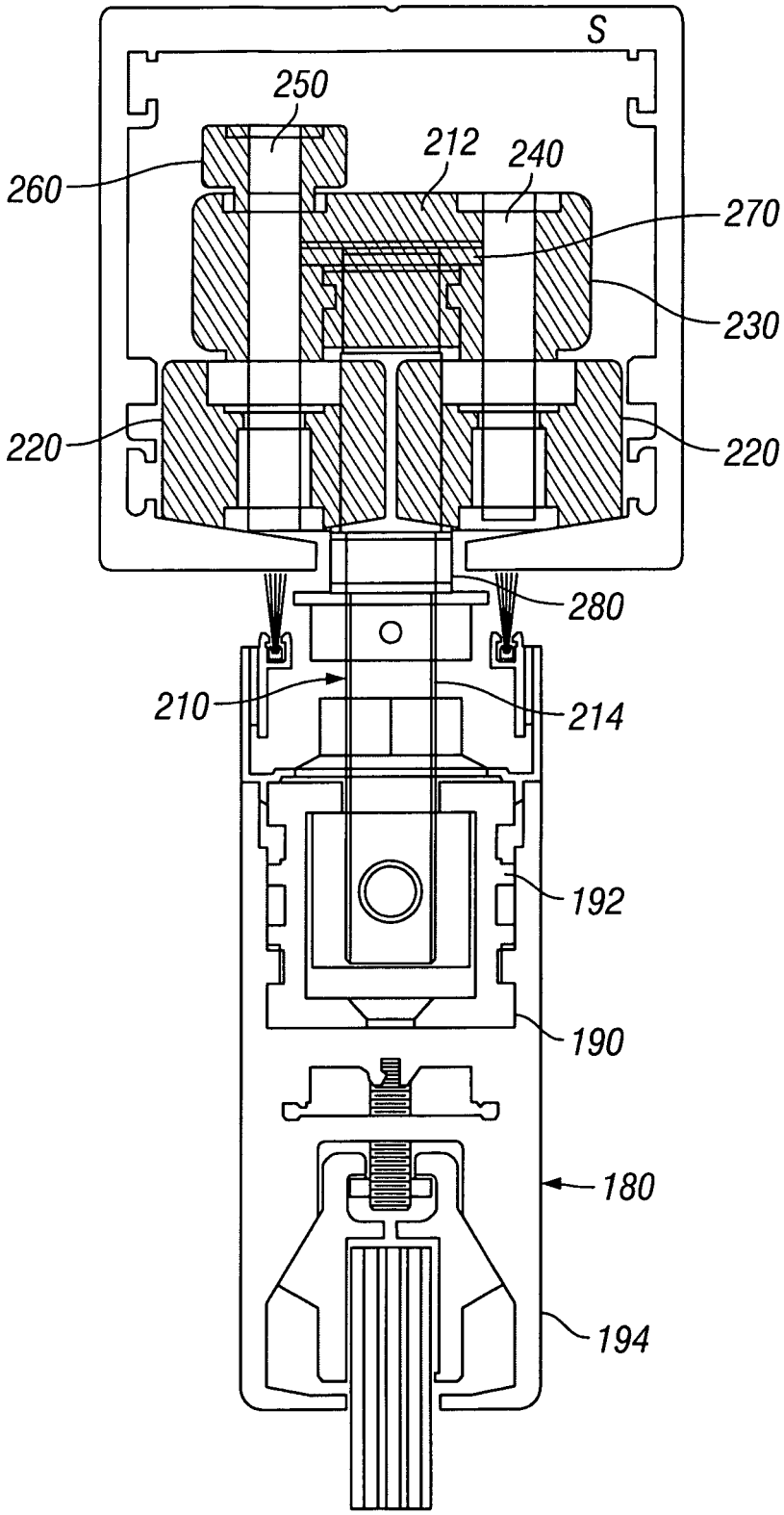

FIGS. 2A-2B depict a preferred embodiment of a trolley in accordance with the present invention. Trolley 200 comprises a housing 230, onto which four wheels 220 are attached. Pendant bolt 210 preferably passes through housing 230 and extends down beneath wheels 220, to connect wall panel 180 to trolley 200.

Wheels 220 are substantially cylindrical in shape and are disposed symmetrically, such that each wheel 220 is equidistant from two adjacent wheels 220. Each wheel 220 comprises a wheel side 222 and a wheel bottom 224. Wheel 220 rotates horizontally around a vertical axis and preferably comprises a beveled edge 226 on the bottom surface, between wheel side 222 and wheel bottom 224. Preferably, beveled edge 226 is a load-bearing surface. In one method of use, the load borne by trolley 200 is communicated to track 300 primarily through beveled edge 226 and wheel bottom 224. Wheel side 222 may contact the track 300 to help align carrier housing 230 within track 300.

Wheels 220 may rotate about short axles 240 or long axles 250. A long axle 250 is longer than a short axle 240, and the extra length allows for mounting of a diverter roller 260. Diverter rollers 260 interact with a diverter 400 (described below and illustrated in FIG. 4) to guide wall assembly 180 along a predetermined path. Preferably, diverter rollers 260 have a smaller diameter than wheels 220 when used with a track 300 having straight smooth side surfaces. Additionally, bearings 290 may be placed between the wheels and axles.

Pendant bolt 210 extends through housing 230 and protrudes downward, becoming housed in a recess 190 in panel header beam 194 and engaging header support block 192, so to provide a secure connection between trolley 200 and wall panel 180. In a preferred embodiment, the pendant bolt 210 has a head 212 that is wider than bolt body 214. In this embodiment, a central channel 232 through housing 230 is sufficiently large to allow passage of the pendant bolt body 214, but sufficiently narrow to prevent passage of pendant bolt head 212, which may then be seated in a recess within central channel 232. Thus, the load carried by the pendant bolt 210 may be transmitted to the housing 230 through the underside of pendant bolt head 212. In a preferred embodiment, a bushing 270 may be placed between the pendant bolt 210 and the housing 230.

A sleeve 280 may optionally be placed around bolt body 214. In a preferred embodiment, sleeve 280 encircles pendant bolt 210 and is located beneath the wheels 220. Sleeve 280 preferably is configured to reside in the channel 330 between lower surfaces 310 of the track 300 and acts to reduce the likelihood of direct contact from the lower surfaces 310 that may damage the appearance of the track and produce undesirable noise.

Figure 3A:
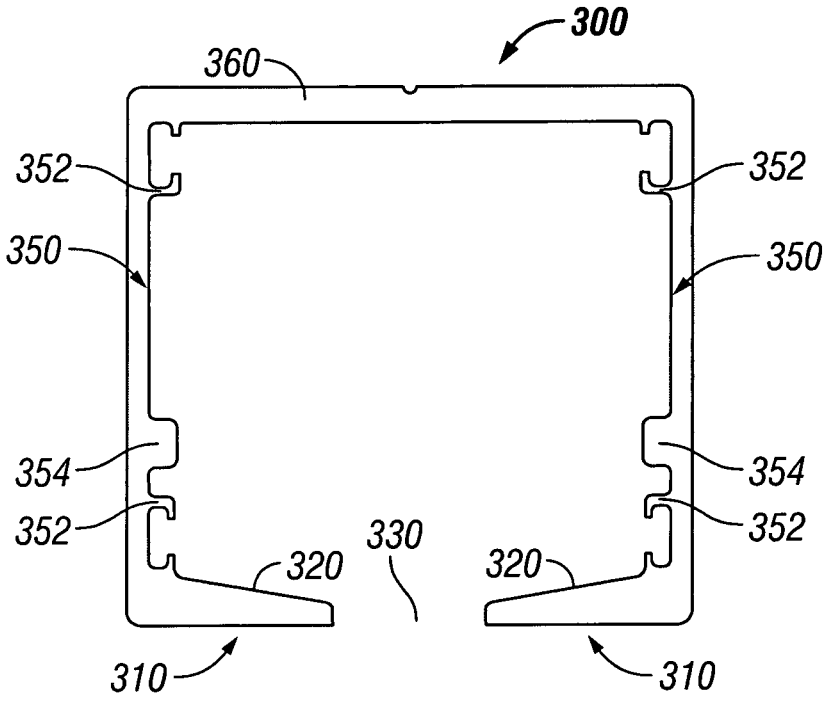

Referring now to FIG. 3A, a cross-section of track 300 is shown. Track 300 comprises an upper surface 360, two side surfaces 350, and two lower surfaces 310, which together surround an interior 340. A channel 330 is disposed between lower surfaces 310.

Side surfaces 350 connect upper surface 360 and lower surfaces 310 and are preferably vertical. The side surfaces 350 extend sufficiently to allow trolley 200 sufficient clearance to roll freely, and therefore may be longer in embodiments having diverter rollers 260 mounted atop the trolley 200. Optional spacers 352 and 354 provide directional stability to trolley 200, avoiding a twisting motion of trolley 200 that would interference with the ability of trolley 200 to move along track 300 freely. In one embodiment, spacers 354 operate as ridges that are positioned at a height corresponding to wheels 220 of trolley 200.

As trolley 200 moves along track 300, trolley 200 is confined within interior 340, although pendant bolt 210 extends between lower surfaces 310 continuing downward. Additionally, sleeve 280 may travel within the channel 330, and may also encroach the interior 340 and the exterior of the track 300.

Side surfaces 350 are separated from each other by a lateral distance slightly greater than the width of trolley 200. In this regard, when trolley 200 moves along track 300, one pair of wheels 220 rolls on each lower surface 310. Moreover, interior 340 of track 300 is sufficiently narrow to prevent housing 230 from rotating as the trolley 200 moves along the track 300, but preferably wide enough such that not all wheels 220 remain in contact with side surfaces 350.

Each lower surface 310 preferably comprises a bevel 320 that tapers downward toward channel 330. Preferably, the free ends of lower surfaces 310 are rounded or otherwise shaped to reduce the presence of sharp edges that may contact trolley 200. Lower surfaces 310 support wheels 220 on trolley 200, and have beveled edge 226 of wheel 220 configured to correspond to the angle of bevel 320 on track 300.

Figure 3B:
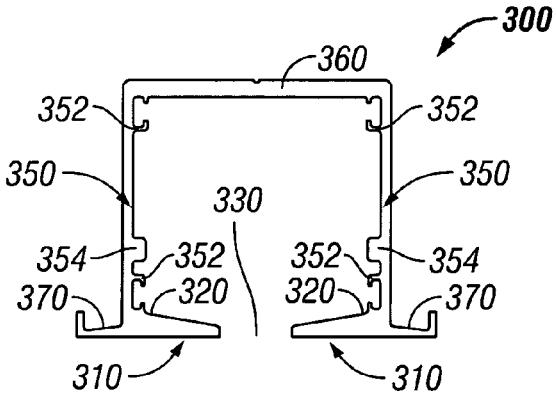

In the variant of track 300 illustrated in FIG. 3B, flanges 370 are disposed along the outer wall of side surfaces 350, to provide greater structural rigidity to track 300, for example, when wall panel system 100 is subject to wind, or to provide a point of anchoring for any additional elements that may be coupled to track 300.

Figure 3D:
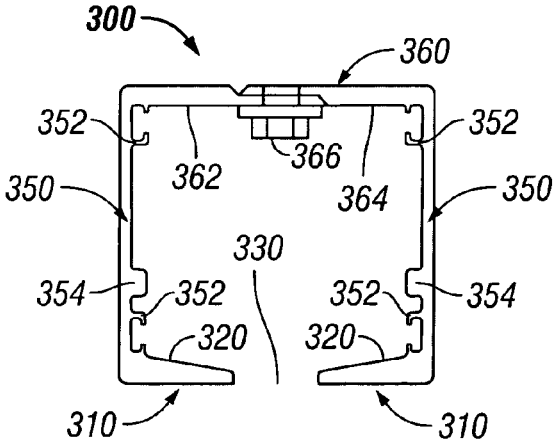
Figure 3E:
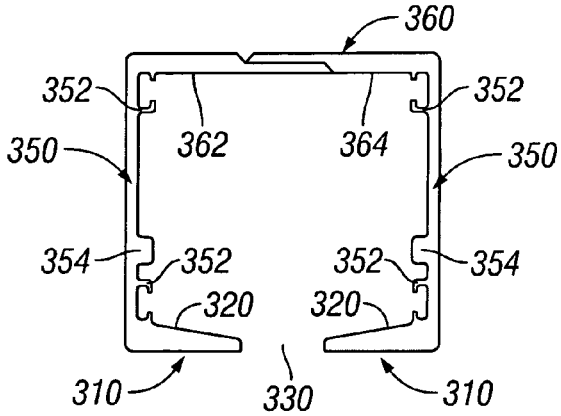
Figure 3C:
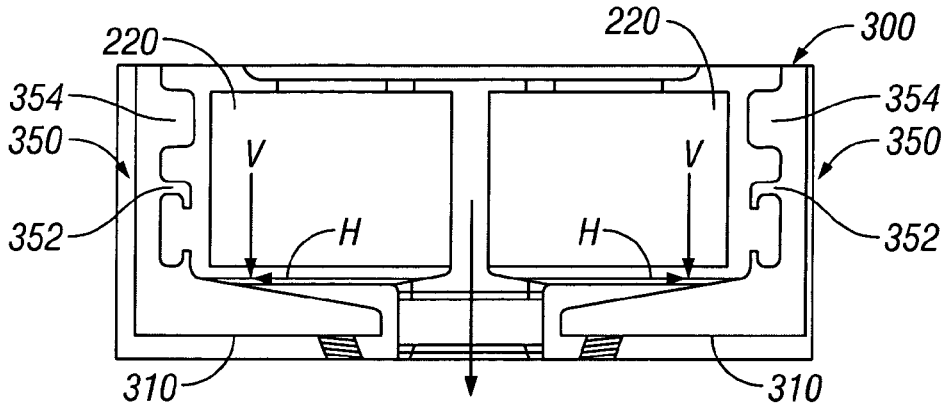

Referring now to FIG. 3C, the interaction between wheels 220 and track 300 is shown. As previously described, wheels 220 rotate along beveled edge 320. The force applied by each one of wheels 220 along beveled edge 320 has a vertical component V and a horizontal component H, which reduces the pure vertical load that would otherwise be carried by track 300 if lower surfaces 310 were not beveled. When bevel 226 is present on wheels 220, the pressure on beveled edge 320 is distributed more evenly, reducing localized wear on track 300.

Track 300 may be manufactured as a single piece, as shown in FIG. 3A, or by joining two or more segments, as shown in FIGS. 3D-3E. More particularly, upper surface 360 may be manufactured by joining a first segment 362 and a second segment 364, by means of a bolt 366, as shown in FIG. 3D, or by welding, as shown in FIG. 3E. Preferably, first segment 362 and second segment 364 overlap at the joint, in order to increase the strength of the joint. This multi-piece construction of track 300 is particularly advantageous when track 300 is not linear, but has curved portions, because the installer may find it easier to bend individual segments 362 and 364 rather than the box-like structure illustrated in FIG. 3A.

Figure 3H:
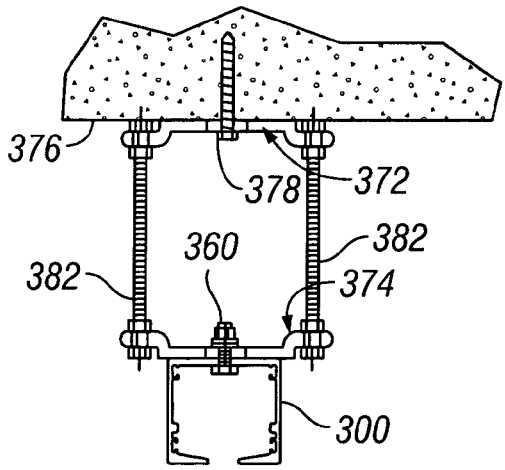
Figure 3I:
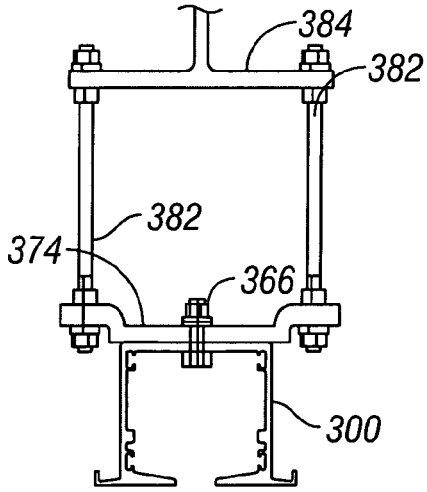
Figure 3F:
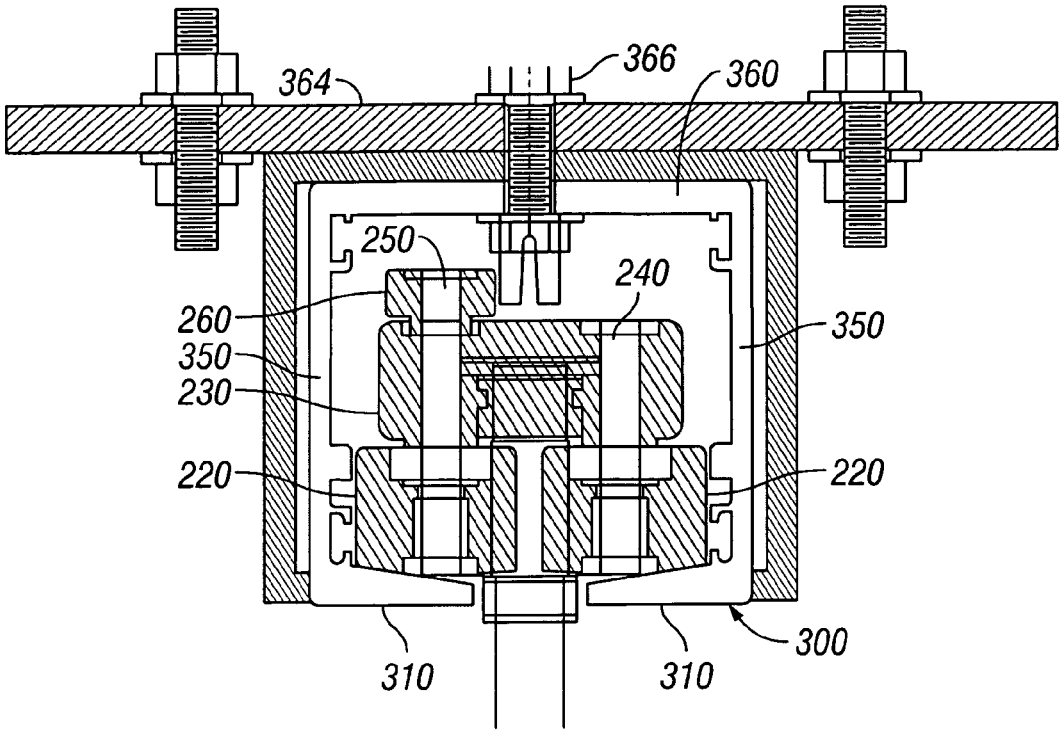
Figure 3G:
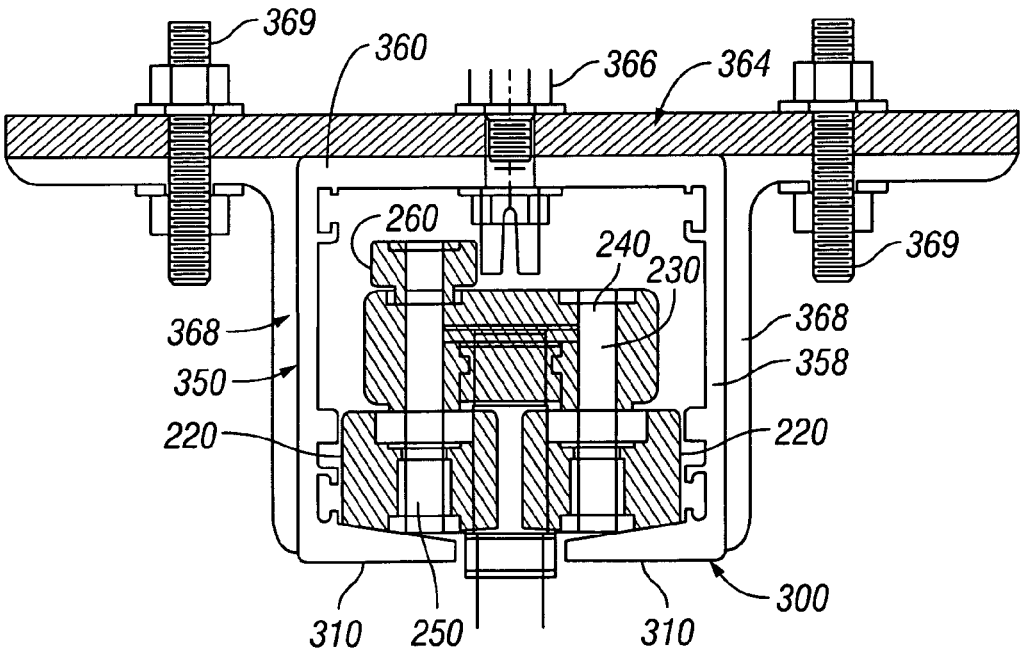

Referring now to FIGS. 3F-3G, it may be desirable to stiffen the structure of track 300, for example, in the areas of wall panel system 100 where wall panels 180 are stacked when not in use, which produces significant higher load conditions on track 300 than elsewhere in the system. Track 300 may be stiffened in a variety of ways, of which a first exemplary embodiment is shown in FIG. 3F and a second exemplary embodiment is shown in FIG. 3G.

With specific reference to FIG. 3F, a reinforcement channel 362 is positioned to surround track 300, providing improved strength and rigidity to upper surface 360 and side surfaces 350. Reinforcement channel 360 and track 300 are anchored to ceiling framing 364 by being commonly joined by a bolt 366, for example, by a 10 mm bolt of suitable length. With further reference to FIG. 3G, two L-shaped lateral flanges 368 are juxtaposed against side surfaces 350 and are connected to ceiling framing 364 by means of bolts 369, while track 300 is separately connected to ceiling framing 364 by bolt 366. In order to improve the connection between lateral flanges 368 and side surfaces 350, an adhesive (for example, a cyanoacrylate adhesive) may be coated on the contact areas between lateral flanges 368 and side surfaces 350. The construction illustrated in FIG. 3G is particularly indicated when the loads carried by track 300 exceed a predetermined amounts, for example, 210 kg, and track 300 may spread laterally if not constrained as in FIG. 3G.

Track 300 may not be anchored directly to a building ceiling, but may be anchored instead to a hanger attachment, due to an excessive ceiling height or for other reasons. Exemplary hanger attachments are illustrated in FIGS. 3H-3J.

Referring first to FIG. 3H, a first bracket 372 is attached to a solid ceiling 374 (for instance, a concrete ceiling) by means of a bolt 378, for example, a 10 mm wedge lock bolt that penetrates ceiling 376 by at least 2.5 cm. A second bracket 374 is connected to track 300 by bolt 366, and the desired spacing between bracket 372 and 374 is provided by inserting bolts 382 between first bracket 372 and second bracket 374.

Referring now to FIG. 3I, track 300 may be suspended not from a solid ceiling, but from a steel beam 384. In this event, the use of first bracket 372 is eliminated, and bolts 382 are attached directly to steel beam 384. The remainder of the hanger structure is the same as in FIG. 3H.

Figure 3J:
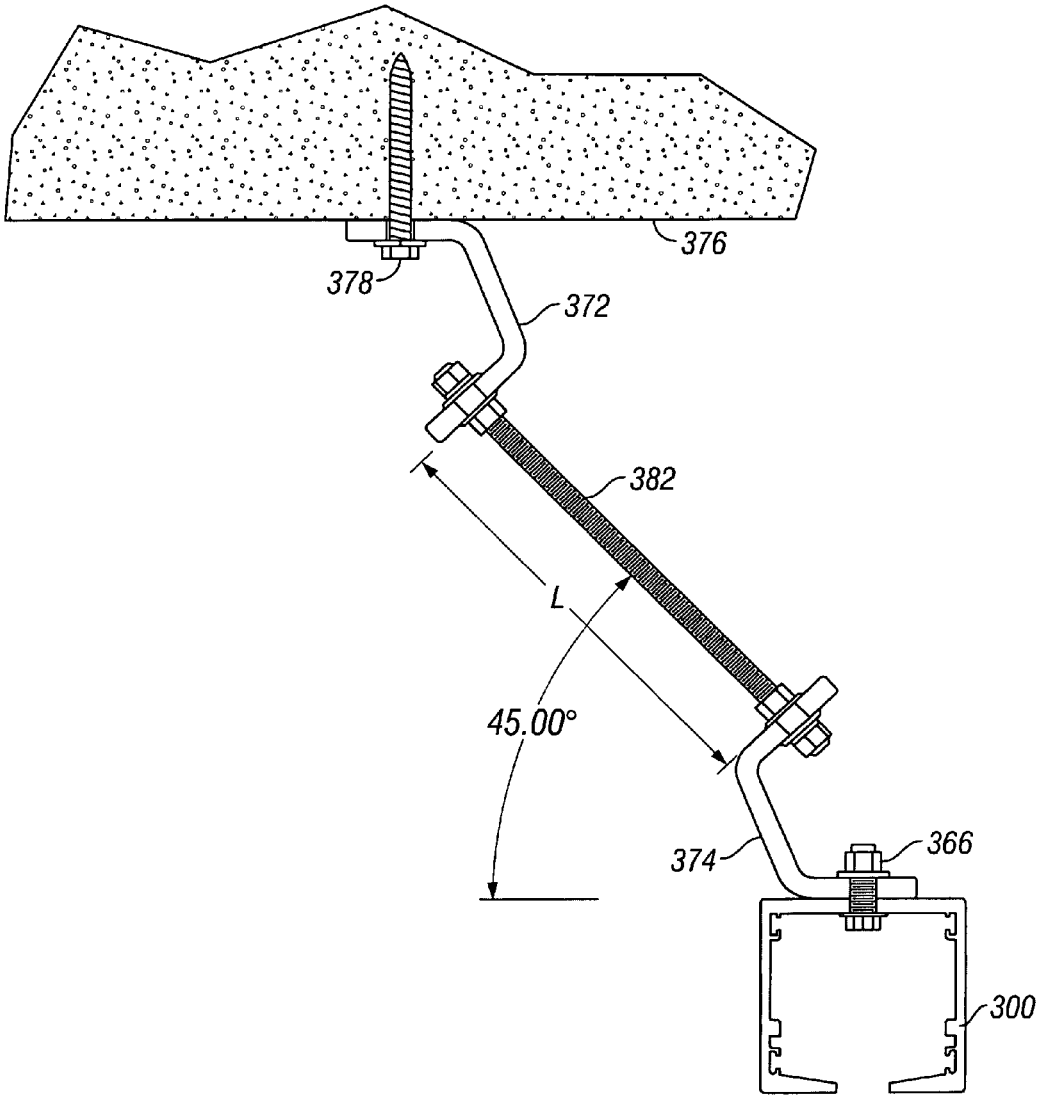

Referring finally to FIG. 3J, track 300 may be suspended from ceiling 376 not with a vertical joint, but with an oblique joint. This type of application may be desired, for example, to restrain side sway of track 300. In this event, first bracket have a shape that reflects the desired lateral and vertical positions of track 300. Typically, first bracket 372 and second bracket 374 have a C-type shape, with terminal segments angled according to the desired lateral and vertical orientations of track 300.

Figure 4:
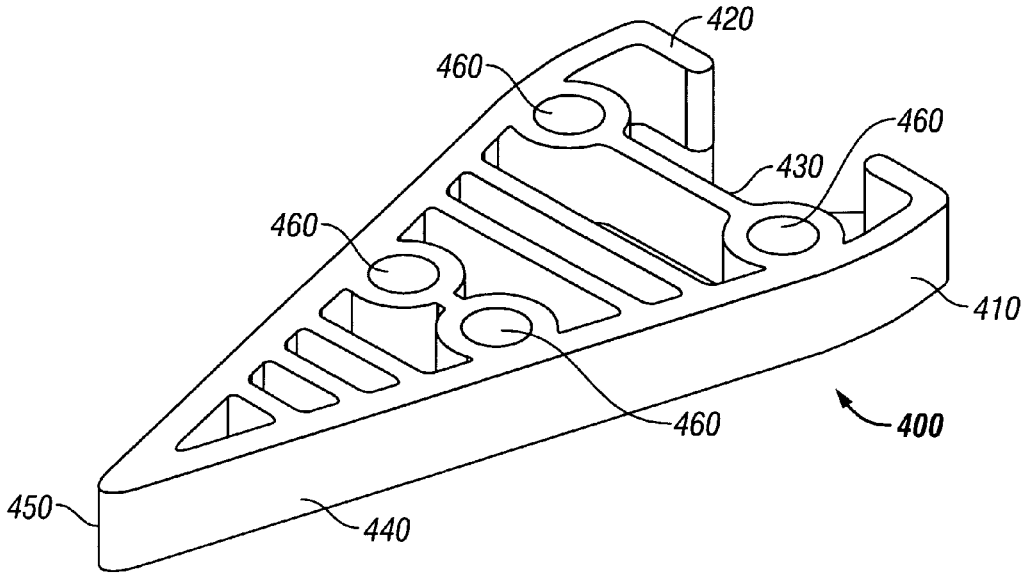
FIG. 4 is a perspective view of an embodiment of a diverter of a wall panel system in accordance with the present invention.

FIG. 4 depicts an embodiment of a diverter 400 in accordance with the present invention. Diverter 400 preferably is located at an intersection of two pathways along track 300 and is attached to the underside of the upper surface 360 of the track 300. Diverter 400 is configured to correspond to the angle of the intersection of the pathways, and, in the embodiment shown in FIG. 4, is configured to correspond to an intersection angle of approximately thirty degrees. Diverter 400 interacts with a guide assembly on trolley 200 to orient trolley 200 along a desired path of travel corresponding to the predetermined orientation of tracks 300. For example, the guide assembly of trolley 200 includes two diverter rollers 260, which are designed to contact the diverter 400 and direct the trolley 200 along a desired pathway, as discussed below.

Diverter 400 comprises a top 420, a side surface 410, a guide portion 440, and a tip 450. In a preferred embodiment, side surface 410 extends from tip 450 to a point beyond guide portion 440, thereby reducing the likelihood of an abrupt directional change as diverter rollers 260 contact diverter 400. Preferably, guide portion 440 has a smooth vertical surface against which diverter rollers 260 can roll.

Diverter 400 may comprise certain geometrical features to correspond to a given intersection. For example, in the embodiment shown in FIG. 4, diverter 400 comprises a blunt tip 450 opposite rear surface 430. Rear surface 430 has a V-shaped opening to facilitate placement within the intersection at the position where side surface 350 of one track pathway meets side surface 350 of an intersecting track pathway. Additionally, diverter 400 may comprise one or more openings 460 along top 420, into which fasteners may be secured. These fasteners may be any type commonly known in the art, such as nuts, bolts, screws, rivets, and other such devices.

Figure 4A:
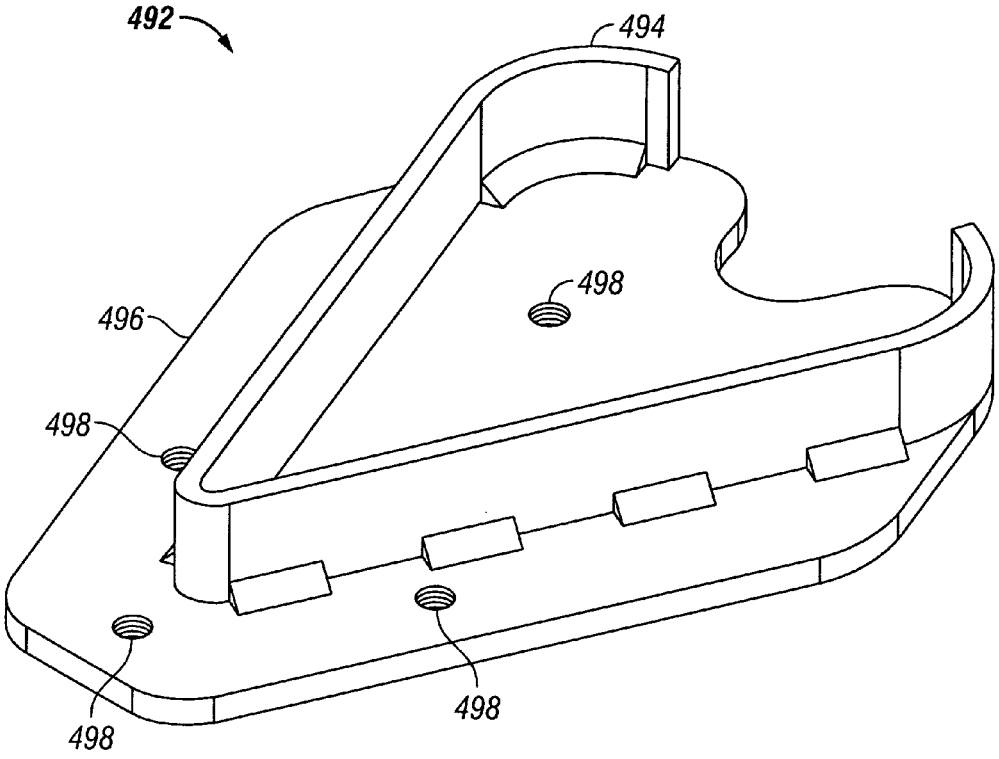
FIG. 4A is a perspective view of a different embodiment of a diverter of a wall panel system in accordance with the present invention.

Diverter 400 may be embodied in a variety of configurations, all aimed at orienting the direction of travel of trolley 200, and all included within the spirit and scope of the present invention. For example, as shown in FIG. 4A, diverter 492 may include an essentially V-shaped portion 494 that orients the direction of travel of trolley 200, and an anchoring plate 496 that is coupled to V-shaped portion 496 and that includes threaded holes 498 for anchoring to a ceiling structure.

Figure 5:
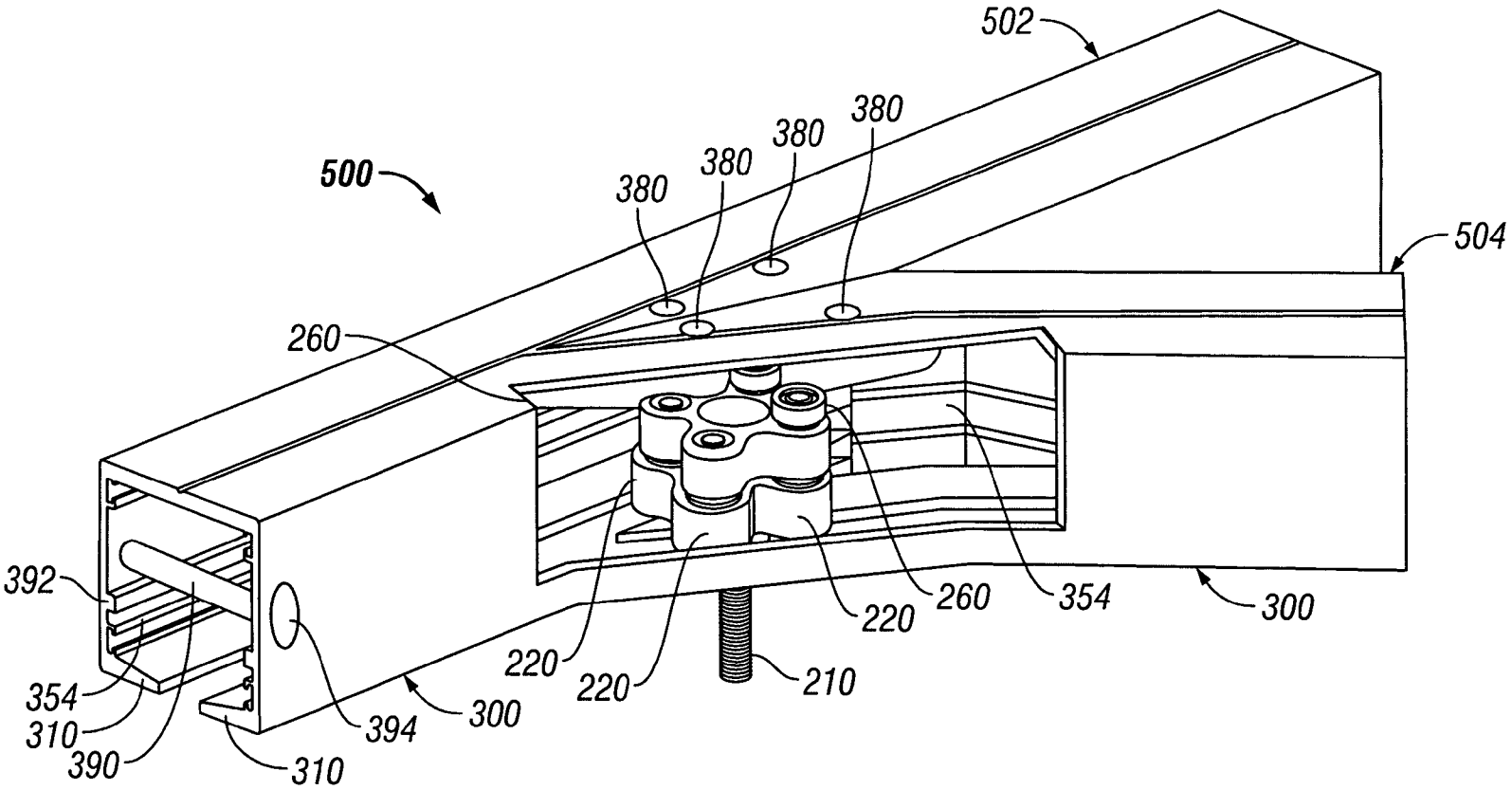
FIG. 5 is a perspective cutaway view of an embodiment of a track and trolley of a wall panel system in accordance with the present invention.

FIG. 5 depicts a perspective view of an intersection 500 of two track pathways that has been partially cut away to partially expose a trolley and diverter in accordance with the present invention. FIG. 5 illustratively represents the mechanism by which diverter 400 guides trolley 200 along a predetermined pathway. Here, first pathway 502 is a straight section of track 300. Branching from first pathway 502 is second pathway 504 along another section of track 300. Track 300 is also shown with optional lateral ridges 354 at a height corresponding to wheels 220 of trolley 200.

At the area where first pathway 502 meets second pathway 504 is a diverter 400 attached to the underside of the upper surface 360 of track 300. The diverter 400 is secured with four fasteners passing through diverter mounting holes 380 along upper surface 360 of track 300. Diverter 400 preferably is oriented such that tip 450 is located at the approximate point at which the centerline of first pathway 502 meets the centerline of second pathway 504.

A terminal 390 is also shown at the endpoint of first pathway 502. Terminal 390 is a mechanism to prevent trolley 200 from inadvertently leaving track 300. In the embodiment shown in FIG. 5, terminal 390 comprises a bolt 392 extending across track 300 and secured in place with a nut 394. In general, terminal 390 may comprise any suitable mechanism for obstructing the travel of trolley 200. For example, terminal 390 may comprise a structure welded across track 300, an exterior structure abutting track 300, mechanical interference devices, or other mechanisms. In a preferred embodiment, terminal 390 is removable to facilitate installation and removal of wall assemblies 180 or to remove and rotate a trolley 200 in order to reposition diverter rollers 260 for alternate configurations. It should be understood that terminal 390 would likely be significantly further from the intersection 500 than illustratively shown in FIG. 5.

For the purposes of the presently described embodiment, it is desired to provide a trolley 200 that is configured to travel from first pathway 502 onto second pathway 504. Here, track 300 has two lower surfaces 310 along first pathway 502 that diverge at intersection 500. One lower surface 310 continues straight along first pathway 502, whereas the other lower surface 310 merges, and is contiguous, with a lower surface 310 along second pathway 504. Thus, trolley 200 is configured such that both diverter rollers 260 are positioned on the same side of housing 230 as lower surface 310 that is contiguous along first pathway 502 and second pathway 504.

As trolley 200 progresses along first pathway 502 toward intersection 500, diverter rollers 260 are not in contact with any portion of track 300. At intersection 500, foremost diverter wheel 260 may come into contact with guide portion 440 on the side surface 410 of diverter 400 near tip 450. As trolley 200 continues into intersection 500, interior 340 of track 300 widens. Due to the contact between the guide portion 440 and foremost diverter roller 260, trolley 200 is forced to begin altering its course from straight along first pathway 502 toward second pathway 504.

As trolley 200 continues forward, second diverter roller 230 may contact guide portion 440 on side surface 410 of diverter 400 near tip 450. Trolley 200 is then prevented from continuing along first pathway 502 by the interaction between diverter rollers 230 and diverter 400. At this point in time, shown in FIG. 5, trolley 200 is within intersection 500, but also still along second pathway 504. As trolley 200 proceeds along second pathway 504, foremost diverter roller 230 and then second diverter roller 230 disengage diverter 400, allowing trolley 200 to exit intersection 500 along the desired route.

As should be clear to those of skill in the art, an alternative trolley configuration may exist corresponding to intersection 500 shown in FIG. 5. In that alternative configuration, trolley 200 has diverter rollers 230 mounted above lower surfaces 310 of track 300 that continue straight along first pathway 502. Thus, the alternatively configured trolley 200 would proceed straight through intersection 500 shown in FIG. 5 without branching along second pathway 504.

Figure 6:
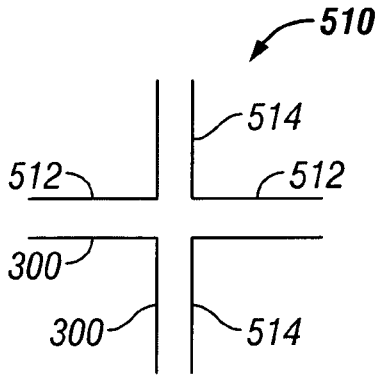
FIG. 6 is a diagrammatic view of an embodiment of a first track intersection in accordance with the present invention.

FIG. 6 depicts an alternative embodiment of an intersection in accordance with the present invention. Here, an intersection 510 is an "X" type intersection in which the intersecting pathways cross at an angle of approximately ninety degrees. As shown, a first pathway 512 and a second pathway 514 cross at right angles. A trolley 200 entering intersection 510 along the first pathway 512 can continue along first pathway 512, turn right onto second pathway 514, or turn left onto second pathway 514.

Figure 7:
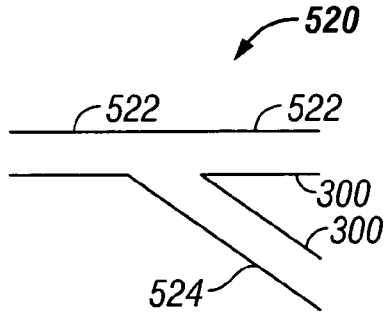
FIG. 7 is a diagrammatic view of an embodiment of a second track intersection in accordance with the present invention.

FIG. 7 depicts an alternative embodiment of an intersection in accordance with the present invention. Here, an intersection 520 is a "Y" type of intersection in which the intersecting pathways cross at an angle other than ninety degrees. As shown, first pathway 522 is essentially straight, and second pathway 524 branches from first pathway 522 at a non-orthogonal angle. A trolley 200 entering intersection 520 the first pathway 522 can either continue along first pathway 522 or turn onto second pathway 524. In a preferred embodiment having a wall assembly 180 with two trolleys 200, each of trolleys 200 would be configured identically such that guide wheels 260 are located along the same side of track 300 as the desired direction of travel, such that diverter 400 may direct trolleys 200 appropriately.

Figure 8:
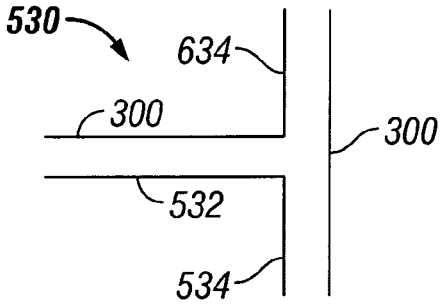
FIG. 8 is a diagrammatic view of an embodiment of a third track intersection in accordance with the present invention.

FIG. 8 depicts an alternative embodiment of an intersection in accordance with the present invention. Here, the intersection 530 is a "T" type of intersection in which one pathway terminates into another pathway at an angle of approximately ninety degrees. As shown, a first pathway 532 terminates at an intersection 530 with a second pathway 534. A trolley 200 entering intersection 530 along the first pathway 532 can either turn right or left onto second pathway 534.

Figure 9:
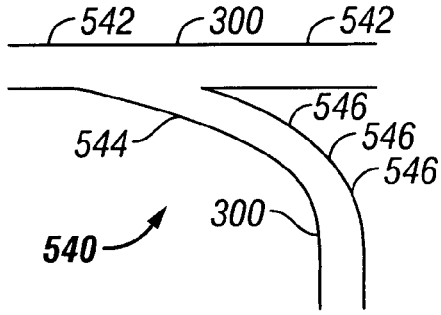
FIG. 9 is a diagrammatic view of an embodiment of a fourth track intersection in accordance with the present invention.

FIG. 9 depicts an alternative embodiment of an intersection in accordance with the present invention. Here, an intersection 540 is a curved branch type of intersection in which one of the intersecting pathways smoothly transitions away from the other pathway. As shown, a first pathway 542 is straight and a second pathway 544 departs at an angle that is initially shallow, but transitions to a full ninety degree change in direction. Here, the second pathway 544 is comprised of a series of short straight segments 546 attached to one another. Other embodiments may comprise a smooth second pathway 544 with a smooth curved surface. In a preferred embodiment having a wall assembly 180 with two trolleys 200, each of trolleys 200 would be configured identically such that guide wheels 260 are located along the same side of track 300 as the desired direction of travel, such that diverter 400 may direct the trolleys 200 appropriately.

Figure 10:
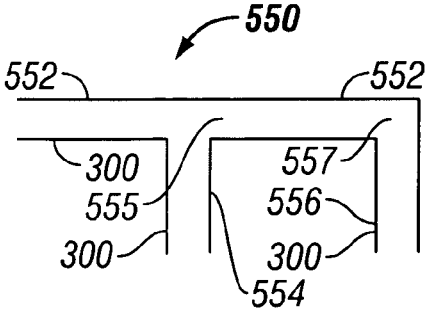
FIG. 10 is a diagrammatic view of an embodiment of a fifth track intersection in accordance with the present invention.

FIG. 10 depicts an alternative embodiment of an intersection in accordance with the present invention. Here, an intersection 550 is an "F" type of intersection suitable for transitioning wall assembly 180 from a serial configuration, in which wall assemblies 180 are positioned edge 140 to edge 140, to a stacked configuration, in which wall assemblies 180 are stacked planar surface 150 to planar surface 150. This type of intersection may be used to position wall assemblies 180 in a storage configuration. Application of intersection 550 is understood by considering wall assembly 180 having two trolleys 220 that is advanced along a first pathway 552 toward the intersection 550. Upon reaching the junction 555, the lead trolley 220 is advanced straight through junction 555 and is advanced to a turn 557. A first parallel pathway 554 and a second parallel pathway 556 are preferably parallel to one another and separated by a distance essentially equal to the spacing between the two trolleys 200 on wall assembly 180. Thus, when lead trolley 220 is at turn 557, the following trolley 220 is at junction 555. At this point, wall assembly 180 is moved laterally such that lead trolley 220 proceeds along second parallel pathway 556 and the following trolley proceeds along first parallel pathway 554. As should be clear, the process is reversed to move a wall assembly 180 from a stacked configuration to a serial configuration.

Figure 11:
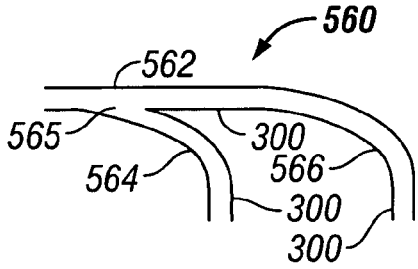
FIG. 11 is a diagrammatic view of an embodiment of a sixth track intersection in accordance with the present invention.

FIG. 11 depicts an alternative embodiment of an intersection in accordance with the present invention. Here, an intersection 560 is a curved type of intersection suitable for transitioning a wall assembly 180 from a serial configuration, in which wall assemblies 180 are positioned edge 140 to edge 140, to a stacked configuration, in which wall assemblies 180 are stacked planar surface 150 to planar surface 150. This type of intersection may be used to position wall assemblies 180 in a storage configuration. A first parallel pathway 566 and a second parallel pathway 564 are preferably parallel to one another and separated by a distance essentially equal to the spacing between the two trolleys 200 on the wall assembly 180. Application of intersection 560 is understood by considering a wall assembly 180 having two trolleys 220 that is advanced along a straight pathway 562 toward intersection 560. The lead trolley 220 is configured with guide rollers 260 mounted on the opposite side of housing 230 as second parallel pathway 564 diverges. In converse, the following trolley 220 is configured with guide rollers 260 mounted on the same side of housing 230 as the second parallel pathway 564 diverges. Upon reaching the junction 565, lead trolley 220 is maintained along straight pathway 562 and then transitions along first parallel pathway 566. The following trolley 220 is guided by diverter 400 upon reaching a junction 565 and proceeds along second parallel pathway 564. As should be clear, the process is reversed to move wall assembly 180 from a stacked configuration to a serial configuration.

Figure 12:
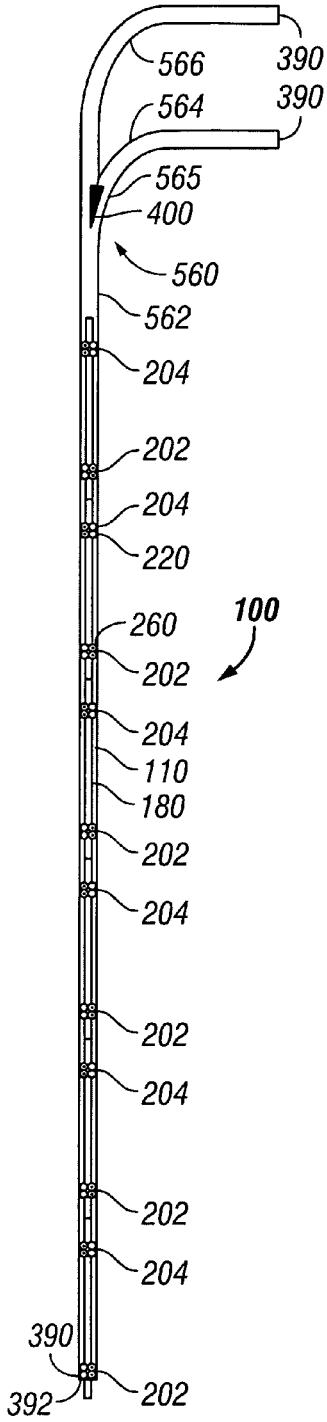
FIG. 12 is a diagrammatic view of a first wall panel system used in accordance with the present invention.
Figure 13:
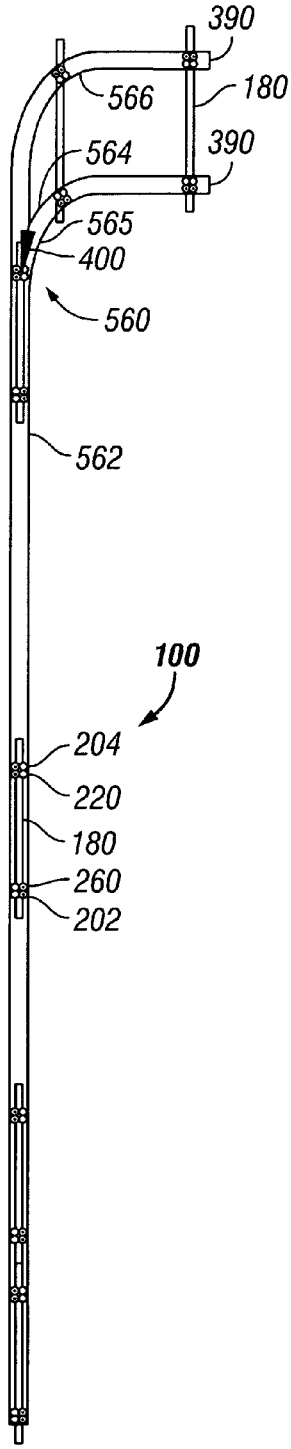
FIG. 13 is a diagrammatic view of a second wall panel system used in accordance with the present invention.
Figure 14:
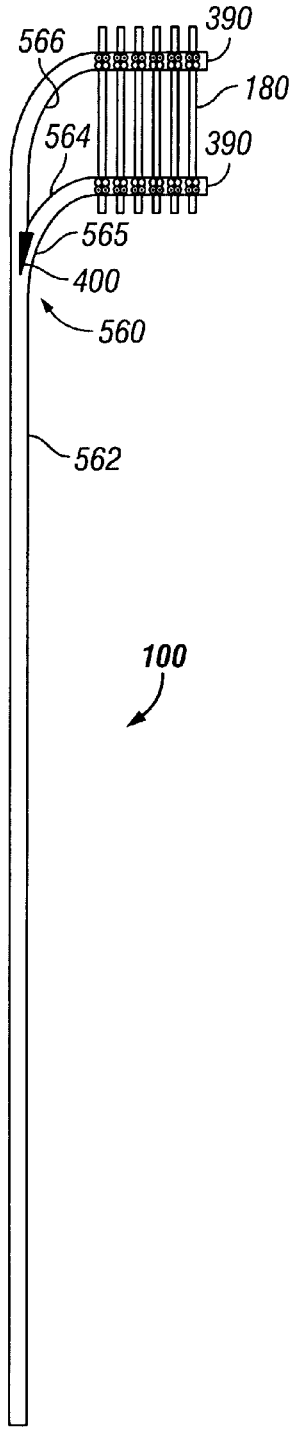
FIG. 14 is a diagrammatic view of a third wall panel system used in accordance with the present invention.

Next, a method of installation and use for a wall panel system according to the present invention is described. In a preferred method of use, wall panel system 100 is configurable to selectively divide a room or store wall assemblies 180. For example, FIGS. 12 to 14 depict an embodiment of a system 100 comprising diverter 400, track 300, and six wall assemblies 180 configurable to be in series or parallel. Track 300 comprises straight pathway 562 along which wall assemblies may be arranged in series. Track 300 further comprises intersection 560, first parallel pathway 566, second parallel pathway 564, junction 565, and terminals 390. Terminals 590 are located at endpoints of track 300 and prevent trolleys 200 from inadvertently leaving track 300. Retainer 392 represents one of the terminals 390 that is configured to be removably attached to track 300. Each wall assembly 180 comprises a wall panel 110 and two trolleys 200, referred to here as first trolley 202 and second trolley 204, each trolley 200 having wheels 220 and diverter rollers 260. First trolley 204 is configured to follow straight pathway 562 and first parallel pathway 566, whereas second trolley 202 is configured to follow straight pathway 562 and second parallel pathway 564.

In installing wall panel system 100 shown in FIGS. 12 to 14, retainer 392 is removed to allow the trolleys 200 to be placed within track 300, such that pendant bolt 210 extends through channel 330 and supports wall panel 110. After retainer 392 is removed, first trolley 204 is inserted into interior 340 of track 300 such that the two diverter rollers 260 are positioned on the opposite side of track 300 as the direction that the second parallel pathway 564 branches from straight pathway 562. Once properly oriented, first trolley 204 is advanced along straight pathway 562 until second trolley 202 is in position to be placed into interior 340 of track 300. Before placing second trolley 202 into track 300, second trolley 202 is first rotated such that diverter rollers 260 are positioned on the same side of track 300 as the direction the second parallel pathway 564 branches from first pathway 562. When positioned properly, diverter rollers 260 on first trolley 204 are on the opposite side of track 300 as diverter rollers 260 on second trolley 202. Each of the other wall assemblies 180 is coupled with track 300 in the same manner. Once all desired wall assemblies 180 are attached to track 300, retainer 392 is reattached to track 300. At this point in time, system 100 may resemble the configuration shown in FIG. 12.

In using the wall panel system 100 shown in FIGS. 12 to 14, a serial configuration of wall assemblies 180, such as shown in FIG. 12, can be re-configured into a parallel configuration, as shown in FIG. 14. To accomplish this re-configuration, each of wall panel assemblies 180 is advanced to intersection 560, where trolleys 200 interact with diverter 400 to become positioned on the proper path. When first trolley 204 reaches diverter 400, diverter rollers 260 are held in their straight orientation by diverter 400. Accordingly, first trolley 204 continues along straight pathway 562 as second trolley 202 continues toward intersection 560. When the second trolley reaches intersection 560, diverter rollers 260 interact with diverter 400, redirecting the second trolley along second parallel pathway 564. As this movement occurs, first trolley 204 is redirected along first parallel pathway 566. Accordingly, wall assembly 180 moves away from straight pathway 562 and into an area suitable for storage. Subsequent wall assemblies 180 may proceed through intersection 560 in the same manner, as illustratively shown in FIG. 13. Once all wall assemblies 180 have passed through intersection 560, they attain the stacked configuration suitable for storage, as shown in FIG. 14, and the previously divided room is now open. As should be clear, a stacked configuration of wall assemblies 180 may be reconfigured to a serial configuration by the reversal of the above steps.

Figure 15:
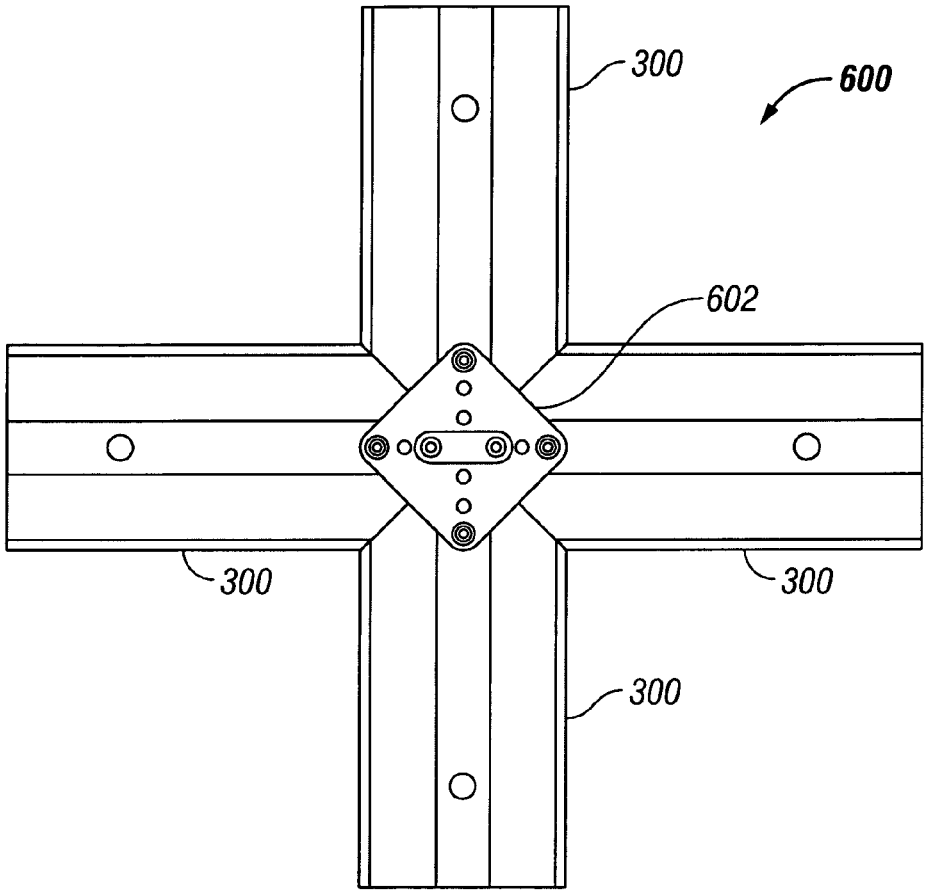
FIG. 15 illustrates an assembly of four track abutted perpendicularly.
Figure 16:
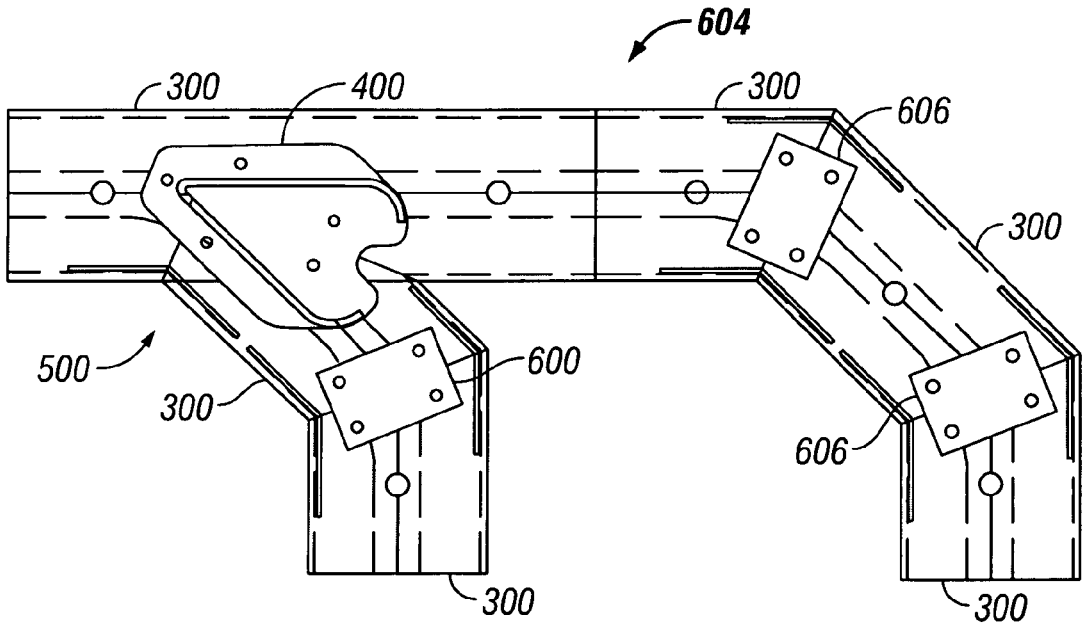
FIG. 16 illustrates an assembly of a plurality of tracks.
Figure 17:
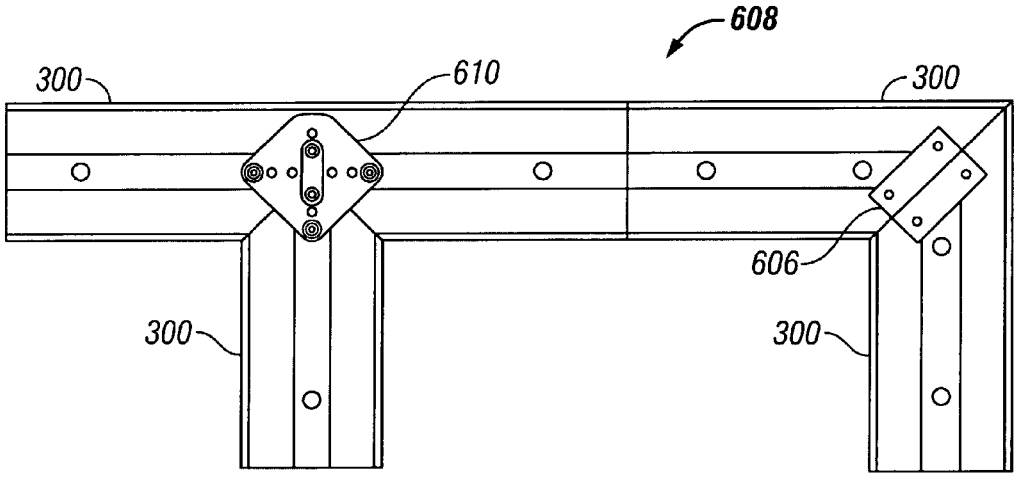
FIG. 17 illustrates an assembly of two tracks abutting perpendicularly.

FIGS. 15-17 illustrate different methods for joining multiple tracks 300. More particularly, FIG. 15 illustrates assembly 600 of four-track 300 abutted perpendicularly and connected by means of four-way plate 602. Instead, FIG. 16 illustrates assembly 604 of a plurality of tracks 300, in which diverter 400 orients the direction of travel of trolley 200 at intersection 500 composed of two tracks 300 abutting laterally, and also in which two-way plate 606 connects two tracks 300 abutting at their ends. Finally, FIG. 17 illustrates assembly 608, in which three-way plate 610 joins two tracks 300 abutting perpendicularly, that is, one abutting into a notch within the other, and also in which two-way plate 606 joins two tracks 300 abutting perpendicularly at their ends.

Thus, it is seen that a wall panel system and method of installation and use are provided. One skilled in the art will appreciate that the present invention can be practiced by other than the preferred embodiments which are presented in this description for purposes of illustration and not of limitation, and the present invention is limited only by the claims that follow. It is noted that equivalents for the particular embodiments discussed in this description may practice the invention as well.

What is claimed is:

1. A wall panel trolley comprising:

a housing having an upper surface and one or more side surfaces, the housing defining a substantially vertical central axis;

a plurality of wheels each rotatably coupled to the housing via a respective vertically oriented axle mounted on the housing, a first set of wheels mounted to a short axle and a second set of wheels mounted to a long axle, each of said wheels including a lower contact surface; and a guide assembly comprising one or more diverter rollers mounted to the housing offset from the central axis via the long axle, the long axle extending from the housing and positioning the diverter roller outside of the housing.

2. The wall panel trolley of claim 1 wherein the guide assembly is configured to impinge upon a diverter positioned on a panel trolley track and direct the wall panel trolley along a predetermined pathway.

3. The wall panel trolley of claim 1 wherein the diverter rollers are smaller than the wheels.

4. The wall panel trolley of claim 3 wherein the diverter rollers have a smaller diameter than the wheels.

5. The wall panel trolley of claim 3 wherein the diverter rollers are smaller in height than the wheels.

6. A wall panel trolley comprising:

a housing having an upper surface and one or more side surfaces, the housing defining a substantially vertical central axis;

a first axle and a second axle relatively longer than the first axle;

a plurality of load-bearing wheels each rotatably coupled to the housing via a respective axle mounted substantially vertically on the housing, at least one of the wheels mounted on the first axle and at least a second one of the wheels mounted on the second axle, each of said wheels including a lower contact surface;

wherein a portion of the second axle extends above said upper surface of the housing, offset from the central axis of the housing.

7. The wall panel trolley of claim 6 in which the at least one diverter roller comprises a first and a second diverter roller offset on the same side from the central axis of the housing.

8. The wall panel trolley of claim 7 further comprising a rotational coupling attached to the housing at the central axis.

9. The wall panel trolley of claim 8 in which the rotational coupling comprises a pendant bolt.

10. The wall panel trolley of claim 9 further comprising a sleeve disposed around the pendant bolt.

11. The wall panel trolley of claim 7 wherein the plurality of wheels comprises four wheels mounted on separate said axles adjacent one another.

12. The wall panel trolley of claim 6 wherein the guide assembly is configured to rotate about an axis substantially perpendicular to the upper surface.

13. The wall panel trolley of claim 6 wherein the acute angle extends from a wheel side substantially to the center of the wheel.

14. The wall panel trolley of claim 6 where the at least one diverter roller comprises two diverter rollers, both diverter rollers being positioned on the same side of the housing.

15. A wall panel trolley comprising:

a housing having an upper surface and one or more side surfaces, the housing defining a substantially vertical central axis;

a plurality of load-bearing wheels each rotatably mounted within the housing via a respective axle mounted substantially vertically on the housing, a first set of wheels located in a first side of the housing and mounted to a short axle and a second set of wheels located in a second side of the housing and mounted to a long axle;

the long axle extending above said upper surface of the housing and offset from the central axis of the housing, the short axle terminating at said upper surface of the housing;

a guide assembly extending from the housing, the guide assembly having at least one diverter roller mounted to the housing via the long axle extending from the housing, and offset from the central axis, positioning at least a portion of the diverter roller above the upper surface of the housing.

16. The wall panel trolley of claim 15 wherein the diverter roller has a smaller diameter than the load-bearing wheels.

17. The wall panel trolley of claim 15 wherein the diverter roller is smaller in height than the load-bearing wheels.

18. The wall panel trolley of claim 15 where the at least one diverter roller comprises two diverter rollers, both diverter rollers being positioned on the same side of the housing.

* * * * *